US010086391B2

(12) United States Patent
Toh et al.

(10) Patent No.: US 10,086,391 B2
(45) Date of Patent: Oct. 2, 2018

(54) PUMP DISPENSER

(71) Applicant: Colgate-Palmolive Company, New York, NY (US)

(72) Inventors: Kiat-Cheong Toh, Forest Hills, NY (US); Joseph Knorr, East Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/320,997

(22) PCT Filed: Jun. 23, 2014

(86) PCT No.: PCT/US2014/043732
§ 371 (c)(1),
(2) Date: Dec. 21, 2016

(87) PCT Pub. No.: WO2015/199651
PCT Pub. Date: Dec. 30, 2015

(65) Prior Publication Data

US 2017/0151580 A1 Jun. 1, 2017

(51) Int. Cl.
*B05B 11/00* (2006.01)
*B05B 15/00* (2018.01)
(Continued)

(52) U.S. Cl.
CPC ..... *B05B 11/0097* (2013.01); *A45D 34/00* (2013.01); *A45D 40/0075* (2013.01);
(Continued)

(58) Field of Classification Search
CPC ..... B05B 11/0097; B05B 11/0037; B05B 11/3045; B05B 15/005; B05B 15/30; A45D 34/00; A45D 40/0075; A47K 5/1211
See application file for complete search history.

(56) References Cited

U.S. PATENT DOCUMENTS 1,316,122 A * 9/1919 Wall ..... B65D 51/2835 222/88
1,779,959 A * 10/1930 Bellocchio ..... A62C 13/003 169/83
(Continued)

FOREIGN PATENT DOCUMENTS

DE 4311141 10/1994
GB 1472178 5/1977
(Continued)

OTHER PUBLICATIONS

International Search Report and the Written Opinion issued in International Application PCT/US2014/043732 dated Feb. 26, 2015. WO.

*Primary Examiner* — Frederick C Nicolas

(57) ABSTRACT

A pump dispenser, having a container with a body defining a chamber for storing a product and defining an opening at a first end of the chamber through which the product is dispensable, the body having a first surface at a second end of the chamber, opposite from the first end; a closure movable between a closed position where the closure blocks the opening and an open position where the opening is not blocked; a pump for pumping the product from the chamber; and a projection extending from the closure, the projection having a first portion extending from the closure and a second portion extending from the first portion, the first and second portions extending in different directions, the second portion having a second surface that faces and approaches the first surface of the body when the closure is moved from the open position to the closed position.

20 Claims, 5 Drawing Sheets

(51) Int. Cl.

| | |
|---|---|
| ***A45D 34/00*** | (2006.01) |
| ***A45D 40/00*** | (2006.01) |
| ***A47K 5/12*** | (2006.01) |
| ***B05B 15/30*** | (2018.01) |

(52) U.S. Cl.
CPC ..... *A47K 5/1211* (2013.01); *B05B 11/0037* (2013.01); *B05B 11/3045* (2013.01); *B05B 15/005* (2013.01); *B05B 15/30* (2018.02)

(56) References Cited

U.S. PATENT DOCUMENTS 3,966,095 A 6/1976 Chappell
4,201,316 A * 5/1980 Klingaman ..... B05B 11/0078 222/136
4,265,372 A * 5/1981 Wainberg ..... B05B 11/0043 222/82
4,813,563 A 3/1989 Ogden
4,871,077 A 10/1989 Ogden
4,946,040 A * 8/1990 Ipenburg ..... B65D 75/5872 215/11.3
5,018,643 A 5/1991 Bolduc
5,031,798 A * 7/1991 Wild ..... B05B 11/0043 222/105
5,127,548 A * 7/1992 Brunet ..... A61J 1/20 222/145.1
5,224,619 A * 7/1993 Dilworth ..... A47G 19/12 220/277
5,273,190 A * 12/1993 Lund ..... B05C 17/00553 222/105
5,328,055 A * 7/1994 Battle ..... B05B 11/0043 222/105
5,509,578 A * 4/1996 Livingstone ..... B05B 11/0037 222/321.6
5,667,098 A * 9/1997 Levine ..... B01L 3/5082 222/1
5,697,524 A * 12/1997 Sedlmeier ..... B01F 13/002 222/105
5,704,723 A 1/1998 Salisian
5,791,519 A * 8/1998 Van Marcke ..... A47K 5/12 222/107
5,975,359 A * 11/1999 Van Marcke ..... A47K 5/12 222/107
6,021,923 A 2/2000 Shipway
6,299,022 B1 * 10/2001 Bublewitz ..... B05C 17/00506 222/105
6,398,073 B1 * 6/2002 Nicolle ..... B67B 7/28 222/105
6,860,389 B2 3/2005 Kraxner
7,165,700 B2 * 1/2007 Macler ..... B67B 7/28 222/105
7,188,749 B2 * 3/2007 Miller ..... B65D 11/18 222/1
7,331,487 B2 * 2/2008 Macler, II ..... B67B 7/28 222/105
8,096,458 B2 1/2012 Hessler
8,146,780 B2 * 4/2012 Compton ..... B67D 7/0205 222/105
8,177,096 B2 * 5/2012 Macler ..... B67B 7/28 222/105
2004/0149779 A1 8/2004 Boll
2005/0016622 A1 1/2005 Risch
2006/0048790 A1 3/2006 Petner
2008/0029541 A1 * 2/2008 Wallace ..... B01F 13/1055 222/129.3
2009/0283541 A1 * 11/2009 Compton ..... B65D 77/068 222/105
2010/0202246 A1 8/2010 Huck et al.
2013/0077898 A1 3/2013 Doll
2014/0110434 A1 4/2014 Ciavarella

FOREIGN PATENT DOCUMENTS

| | | |
|---|---|---|
| GB | 2182304 | 5/1987 |
| GB | 2231925 | 11/1990 |
| JP | 2008050058 | 3/2008 |
| WO | WO00/04998 | 2/2000 |
| WO | WO2004/085586 | 10/2004 |

* cited by examiner

PUMP DISPENSER

CROSS-REFERENCE TO RELATED PATENT APPLICATIONS

The present application is a U.S. national stage application under 35 U.S.C. § 371 of PCT Application No. PCT/US2014/043732 filed Jun. 23, 2014, the entirety of which is incorporated herein by reference.

BACKGROUND

This invention relates to a pump dispenser for dispensing a product, such as an oral, personal or home care product.

It is known to provide a product, such as a liquid hand soap, in a pump dispenser for dispensing the product as desired. In some such pump dispensers, when the product in the dispenser has been exhausted, a user is able to refill the pump dispenser with the product. Often the refilling operation involves the user's hands coming close to, or into contact with, the product, meaning that the user has to go to the trouble of washing their hands afterwards.

There is a need for a pump dispenser that can be operated by a user to replenish the pump dispenser with an oral, personal or home care product with reduced risk of the user coming into contact with the product.

BRIEF SUMMARY

A first aspect of the present invention provides a pump dispenser, comprising: a container comprising a body defining a chamber for storing a product and defining an opening at a first end of the chamber through which the product is dispensable from the chamber, the body having a first surface at a second end of the chamber, opposite from the first end of the chamber; a closure movable relative to the body between a closed position at which the closure blocks the opening and an open position at which the opening is not blocked by the closure; a pump for pumping the product from the chamber; and a projection extending from the closure, the projection comprising a first portion extending from the closure in a first direction and a second portion extending from the first portion in a second direction, the second direction being different to the first direction, the second portion having a second surface that faces and approaches the first surface of the body when the closure is moved relative to the body from the open position to the closed position.

Optionally, the first portion extends from the closure along an axis and the second portion extends from the first portion radially outwards with respect to the axis.

Optionally, a rim of the body defines the opening, the rim lies in a first plane, and the first portion extends from the closure in a direction normal to the first plane.

Optionally, the first portion of the projection comprises a dip tube with a lumen fluidly connected to the pump. Further optionally, a distal end of the dip tube is further from the closure than the second surface of the second portion.

Optionally, the first portion of the projection is rigid.

Optionally, a distal end of the projection is spaced from the first surface of the body when the closure is at the closed position relative to the body.

Optionally, a distal end of the projection is tapered.

Optionally, the second surface of the second portion contacts the first surface of the body when the closure is at the closed position relative to the body.

Optionally, the second surface of the second portion is spaced from the first surface of the body when the closure is at the closed position relative to the body. Further optionally, the second surface of the second portion is spaced from the first surface of the body by less than 5 millimeters when the closure is at the closed position relative to the body. Still further optionally, the second surface of the second portion is spaced from the first surface of the body by less than 1 millimeter when the closure is at the closed position relative to the body.

Optionally, the first and second surfaces have matching surface profiles.

Optionally, one of the first and second surfaces comprises a recess and the other of the first and second surfaces comprises a protuberance.

Optionally, one of the first and second surfaces is concave and the other of the first and second surfaces is convex.

Optionally, one or each of the first and second surfaces is substantially flat.

Optionally, the first surface of the body is a surface of the body that partially defines the chamber.

Optionally, the body comprises a vessel defining the chamber, and an internal member within the chamber at the second end of the chamber, wherein the first surface of the body is a surface of the internal member.

Optionally, the projection comprises a connector for connecting a refill container to the projection. Further optionally, the connector comprises one of a hook and a clip.

Optionally, the pump is fixed to the closure.

Optionally, the pump is for pumping the product from the chamber through the opening.

Optionally, the container comprises a protrusion extending from the body into the chamber, the protrusion having a sharp distal end in the chamber. Further optionally, the protrusion extends from the body into the chamber at the second end of the chamber.

Optionally, the body is transparent or translucent.

Optionally, the body has a fill mark provided thereon at a position between the first and second ends of the chamber. Further optionally, the pump dispenser comprises a visible indication of a maximum volume of liquid containable in the chamber between the fill mark and the second end of the chamber.

Optionally, the body comprises one or more contact portions at an exterior of the container and lying in a second plane for stably standing the container on a horizontal support surface.

A second aspect of the present invention provides a system, comprising the pump dispenser of the first aspect of the invention; and a refill container comprising a body defining a cavity storing a composition; wherein the refill container is insertable into the chamber through the opening. The pump dispenser of the system may have any of the above-described optional features of the pump dispenser of the first aspect of the invention.

Optionally, the projection comprises a connector for connecting a refill container to the projection, and the refill container comprises a connector for connecting the refill container to the connector of the projection.

Optionally, the composition is an oral, personal or home care composition.

Optionally, the composition comprises water in an amount of less than 98% by weight, based on a total weight of the composition.

Optionally, the composition is one of a toothpaste, a dentifrice, a mouthwash, an antiperspirant composition, a deodorant composition, a skin care composition, a shaving soap, a soap, a hair care composition, a hair shampoo, a hair conditioner, a surface cleaner, a laundry detergent, a fabric cleaner, a fabric conditioner, a fabric softener, and a dish washing composition.

Optionally, the body of the refill container is water-soluble.

Optionally, the body of the refill container is completely dissolvable in water at room temperature and atmospheric pressure within a time period of between 2 and 4 weeks.

Optionally, the body of the refill container is collapsible according to a predetermined pattern of collapse.

Optionally, the body of the refill container is one of a cup, a bag, a sachet, a packet and a pouch.

Optionally, the system comprises a plurality of the refill containers.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

An exemplary embodiment of a container according to the present invention will now be described with reference to FIG. 1, and an exemplary embodiment of a refill container according to the present invention will be described with reference to FIG. 2.

Figure 1:
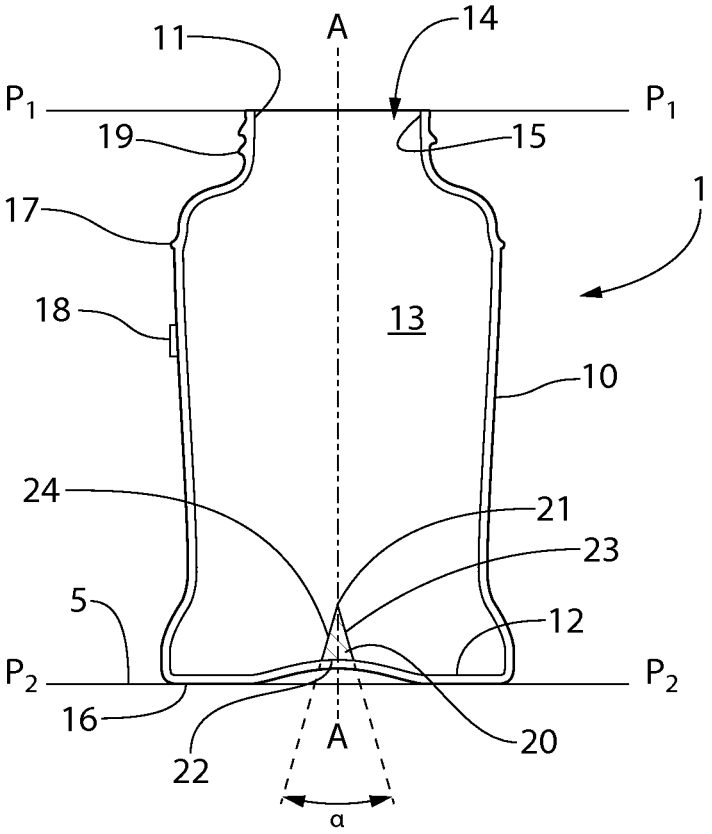
FIG. 1 is a cross section view of a container for a pump dispenser according to an embodiment of the present invention.

FIG. 1 shows the exemplary container designated generally with reference numeral 1. Broadly speaking, the container 1 comprises a body 10 and a protrusion 20 extending from the body 10. The body 10 defines a chamber 13 for storing a product. The chamber 13 has a first end 11 and a second end 12. The body 10, or more specifically a rim 15 of the body 10, defines an opening 14 at the first end 11 of the chamber 13, through which opening 14 the product is dispensable from the chamber 13. The rim 15 lies in a first plane $P_1$-$P_1$. The opening 14 extends along a first axis A-A that is central to the opening 14 and normal to the first plane $P_1$-$P_1$. In the illustrated embodiment, the opening 14 is circular and the first axis A-A passes through a center of the opening 14. In variations to the illustrated embodiment, the opening 14 may be of any other shape, such as elliptical, polygonal, square, rectangular or triangular. However, preferably, but not necessarily, in such variations the opening 14 still extends along a first axis A-A that is central to the opening 14.

The body 10 comprises a contact portion 16 at an exterior of the body 10 and container 1 and lying in a second plane $P_2$-$P_2$, which second plane $P_2$-$P_2$ is parallel to the first plane $P_1$-$P_1$. The contact portion 16 is for stably standing the body 10 and the container 1 as a whole on a horizontal support surface 5. In the illustrated embodiment, the contact portion 16 is annular. The contact portion 16 may be planar or follow an annular line. In variations to the illustrated embodiment, the contact portion may be of a different shape, such as elliptical, polygonal, square, rectangular or triangular. In some variations to the illustrated embodiment, the body 10 comprises a plurality of contact portions lying in the second plane $P_2$-$P_2$. In some variations to the illustrated embodiment, the body 10 comprises one or more non-planar contact portions lying in the second plane $P_2$-$P_2$, such as one or more point apexes or line apexes that are each a portion of a curved or non-planar surface of the body 10, yet the combination of the contact portion(s) of the body 10 enables the body 10 and the container 1 as a whole to stand stably on the horizontal support surface 5. Other configurations of contact portion(s) of the body 10 will be apparent to the skilled person in light of the present disclosure.

The body 10 may be made from any suitable material, such as a hard plastic. Example plastics are thermoplastic polymers, such as polypropylene (PP) or polyethylene terephthalate (PET). The body 10 is transparent, to enable a user to view contents of the chamber 13 from the exterior of the body 10 and container 1. In a variation to the illustrated embodiment, the body 10 may be translucent. In further variations to the illustrated embodiment, some or all of the body 10 may be opaque but, in some such further variations, only a first portion of the body 10 is opaque while a second portion of the body 10 is transparent or translucent, again to enable a user to view contents of the chamber 13 from the exterior of the body 10 and container 1. The body 10 has a fill mark 17 provided thereon at a position between the first and second ends 11, 12 of the chamber 13. The fill mark 17 is visible to a user from the exterior of the body 10 and container 1. The fill mark comprises a fill line that may extend partially or fully around a perimeter of the body 10, so that the fill mark is visible to a user regardless as to the side of the body 10 the user is viewing. In the illustrated embodiment, the fill mark comprises a ridge 17 that protrudes from an exterior surface of the body 10. In variations to the illustrated embodiment, the fill mark may comprise a groove or channel formed in the exterior surface of the body 10, or may comprise printing adhered or otherwise provided on the exterior surface of the body 10. In other variations to the illustrated embodiment, the fill mark may be a ridge, groove or other formation on an interior surface of the body 10, which interior surface of the body 10 delimits the chamber 13. Other configurations of the fill mark will be apparent to the skilled person in light of the present disclosure. The container 1 further comprises a visible indication 18 of a maximum volume of liquid containable in the chamber 13 between the fill mark 17 and the second end 12 of the chamber 13. In the illustrated embodiment, the visible indication 18 comprises text provided on the exterior surface of the body 10, but in variations to the illustrated embodiment the visible indication 18 may comprise text or another indication provided on the interior surface of the body 10 or elsewhere on the container 1.

In the illustrated embodiment, the protrusion 20 is non-unitary with the body 10 and is affixed to the body 10, specifically to the interior surface of the body 10. The protrusion 20 may be made from metal, such as aluminium, or a hard plastic. Example plastics are thermoplastic polymers, such as polypropylene (PP) or polyethylene terephthalate (PET). In variations to the illustrated embodiment, the protrusion 20 may be unitary with the body 10. In such variations, it is preferred that the body 10 and the protrusion 20 be molded from a plastic, such as those discussed above for the protrusion 20.

The protrusion 20 extends from the body 10, and more specifically from the interior surface of the body 10, into the chamber 13 at the second end 12 of the chamber 13, the second end 12 being opposite from the first end 11 of the chamber 13. The protrusion 20 has a sharp distal end 21 in the chamber 13, which sharp distal end 21 is suitable for piercing a body of the refill container 40 discussed below. The protrusion 20 extends from the body 10 towards the opening 14, so that the distal end 21 faces the opening 14 and the refill container 40 as it is dropped into the chamber 13, as discussed below. In the illustrated embodiment, the protrusion 20 extends from the body 10 in a direction normal to the first plane $P_1$-$P_1$ and all of the protrusion 20 extends along the first axis A-A, so that both a proximal end 22 and the distal end 21 of the protrusion 20 lie on the first axis A-A. In variations to the illustrated embodiment, the protrusion 20 extends from the body 10 towards the opening 14 but does not, or does not fully, lie on the first axis A-A. For example, the distal end 21 of the protrusion 20 may lie on the first axis A-A, while the proximal end 22 of the protrusion 20 is remote from the first axis A-A, whereby the protrusion 20 could be considered to extend along a path that is oblique to the first axis A-A. Alternatively, neither the distal end 21 nor the proximal end 22 of the protrusion 20 may lie on the first axis A-A, yet the protrusion 20 may still extend from the body 10 in a direction normal to the first plane $P_1$-$P_1$. In some embodiments, the protrusion 20 may have a curve or kink in it, so that the distal end 21 lies on the first axis A-A and a further portion of the protrusion 20 extends along the first axis A-A, while the proximal end 22 of the protrusion 20 is remote from the first axis A-A. Other configurations of the protrusion 20 will be apparent to the skilled person in light of the present disclosure. In some embodiments, the container 1 comprises a plurality of protrusions 20 extending from the body 10 into the chamber 13, each of the plurality of protrusions 20 having a sharp distal end 21 in the chamber 13. Some or all of the plurality of protrusions 20 may be at the second end 12 of the chamber 13 opposite from the first end 11 of the chamber 13.

Figure 6:
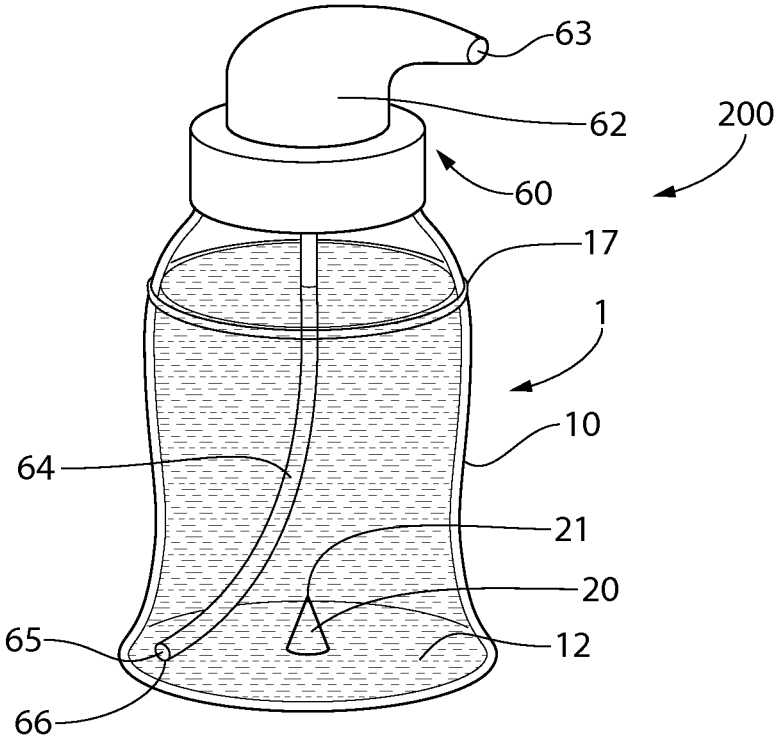
FIG. 6 is a perspective view of a pump dispenser according to an embodiment of the present invention, the pump dispenser comprising the container of FIG. 1.

In the illustrated embodiment, the protrusion 20 tapers to a point at the distal end 21 of the protrusion 20. That is, the distal end 21 of the protrusion 20 is a point. Two sides 23, 24 of the protrusion 20 meet at an angle $\alpha$ of approximately 25 degrees to form the point. The angle $\alpha$ may be different in variations to the illustrated embodiment, but preferably the angle $\alpha$ is less than 45 degrees, and more preferably the angle $\alpha$ is less than 30 degrees. The smaller the angle $\alpha$, the more easily the protrusion 20 is able to pierce the body of the refill container 40. In variations to the illustrated embodiment, the distal end 21 of the protrusion 20 may be an edge, so that the protrusion 20 tapers to the edge at the distal end 21 of the protrusion 20. In such variations, preferably two sides of the protrusion 20 still meet at an angle of less than 45 degrees, and more preferably less than 30 degrees. As is best seen in FIG. 6, the protrusion 20 is rotationally symmetric about an axis that extends from the proximal end 22 of the protrusion 20 to the distal end 21 of the protrusion 20. In the illustrated embodiment, this axis is coextensive with the first axis A-A discussed above.

Figure 2:
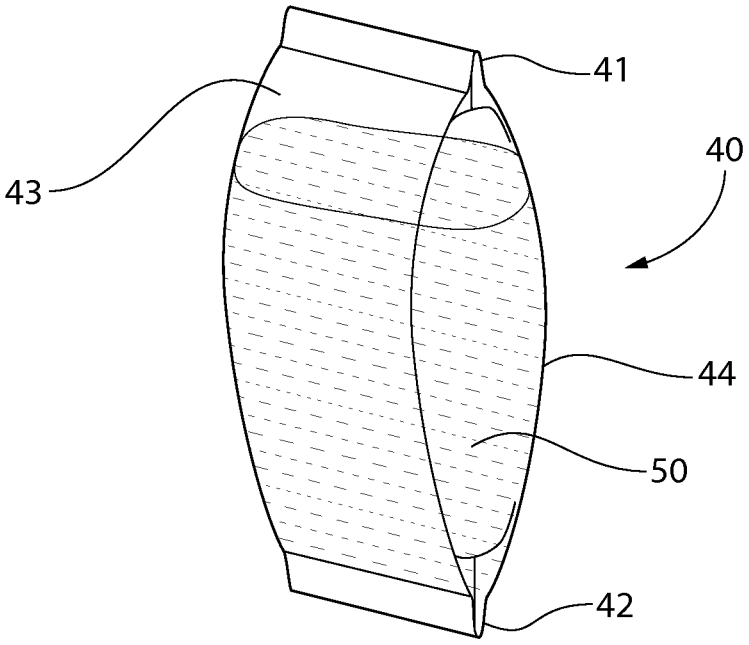
FIG. 2 is a perspective view of a refill container according to an embodiment of the present invention.
Figure 3:
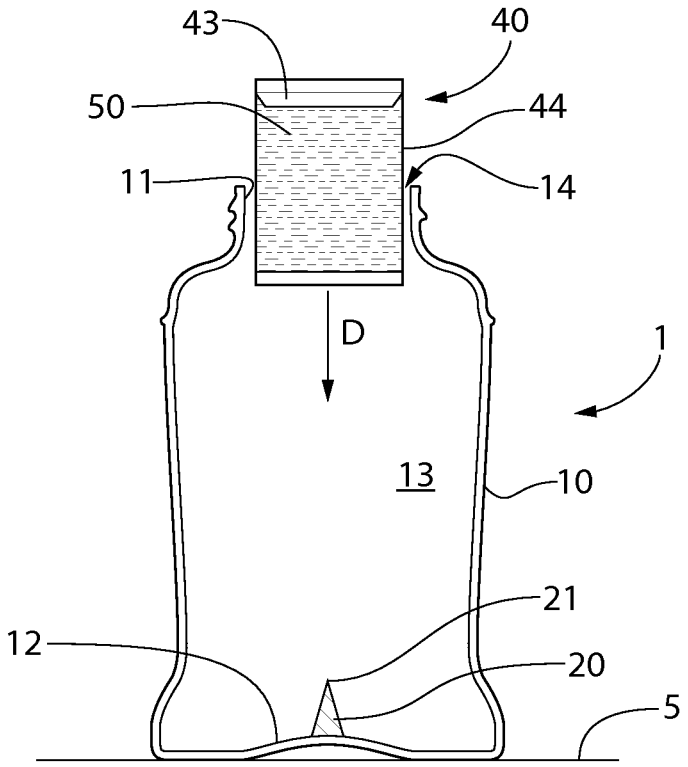
FIG. 3 is a cross section view of the refill container of FIG. 2 being dropped into a chamber of a body of the container of FIG. 1.

FIG. 2 shows the exemplary refill container designated generally with reference numeral 40. The refill container 40 is dimensioned so as to be insertable into the chamber 13 through the opening 14 of the container 1. The refill container 40 comprises a body 44 in the form of a pouch. The body 44 has first and second ends 41, 42, which may be crimped closed or heat-sealed. The body 44 envelops a cavity 43 storing an oral, personal or home care composition 50. Herein, by "envelops" it is meant "encloses or surrounds completely on all sides". In the illustrated embodiment, the body 44 is a unitary body enveloping the cavity 43 and the composition 50 stored therein, but in variations to the illustrated embodiment the body 44 may comprise two or more non-unitary components that have been connected together to form the body 44. The body 44 is free of any predefined openable passageways, such as an opening or orifice closed by a removable plug or other closure, for placing the cavity 43 in fluid communication with an exterior of the body 44. Moreover, the body 44 is impermeable to the composition 50. Accordingly, over a predetermined period of time, which may be an infinite period of time or a finite period of time, such as six months or a number of years, the composition 50 is unable to pass through the body 44 from the cavity 43 to the exterior of the body 44. However, the body 44 of the illustrated embodiment is water-soluble. More specifically, the body 44 of the refill container 40 is completely dissolvable in water at room temperature and atmospheric pressure within a predetermined time period, such as a time period of between 2 and 4 weeks. Thus, while the body 44 is impermeable, so that the composition 50 cannot pass through the material of the body 44, over time the body 44 can degrade to create passages through the body 44 to place the cavity 43 in fluid communication with an exterior of the body 44, and the composition 50 could then pass through the passages. Herein, by "room temperature" it is meant a temperature of 20 degrees Celsius, and by "atmospheric pressure" it is meant a pressure of 101 kPa. In variations to the illustrated embodiment, the body 44 is not water soluble.

The body 44 has thin walls. More specifically, the body 44 has a thickness, i.e. a wall thickness, between the cavity 43 and the exterior of the body 44 of approximately 60 microns. The thickness may be different in variations to the illustrated embodiment, but preferably the thickness is no more than 650 microns, more preferably the thickness is no more than 200 microns, and still more preferably the thickness is no more than 100 microns. The thickness may be between 5 and 650 microns, more preferably between 10 and 200 microns, and more preferably between 15 and 100 microns. The smaller the thickness, the more easily the protrusion 20 is able to pierce the body 44 of the refill container 40.

The composition 50 stored in the cavity 43 of the refill container 40 is in concentrated form, and is intended to be used when dissolved or diluted in a predetermined volume of water to form a volume of oral, personal or home care product. Accordingly, the refill container 40 is smaller and in some embodiments may require less material in its manufacture than an equivalent refill container 40 storing the volume of oral, personal or home care product in non-concentrated form. In other embodiments, the refill container 40 may use the same material in its manufacture as the equivalent refill container 40 storing the volume of oral, personal or home care product in non-concentrated form. In the illustrated embodiment, the composition 50 comprises water in an amount of about 50% by weight, based on a total weight of the composition 50. In variations to the illustrated embodiment, the composition 50 may comprise water in a different amount by weight, based on a total weight of the composition 50, but in any event the composition 50 comprises water in an amount of less than 98% by weight, based on a total weight of the composition 50. In various different embodiments to that illustrated, and based on a total weight of the composition 50, the composition 50 comprises water in an amount of less than 95% by weight, or less than 90% by weight, or less than 85% by weight, or less than 80% by weight, or less than 75% by weight, or less than 70% by weight, or less than 65% by weight, or less than 60% by weight, or less than 55% by weight, or less than 50% by weight, or less than 45% by weight, or less than 40% by weight, or less than 35% by weight, or less than 30% by weight, or less than 25% by weight, or less than 20% by weight, or less than 15% by weight, or less than 10% by weight, or less than 5% by weight, or less than 2% by weight, or less than 1% by weight. Since, in the illustrated embodiment, the body 44 is water-soluble, it is preferred that the water content of the composition 50 be as little as possible. In some embodiments, the composition 50 comprises water in an amount of less than 0.5% by weight, based on a total weight of the composition 50.

As discussed above, the composition 50 is an oral care composition, a personal care composition, or a home care composition. Preferably, the composition 50 is an oral care composition or a personal care composition. More preferably, the composition is a personal are composition. Herein, by "oral care composition" it is meant "a composition for which the intended use can include oral care, oral hygiene, or oral appearance, or for which the intended method of use can comprise administration to (and not just via) the oral cavity". Example oral care compositions include toothpaste, dentifrice, and mouthwash. When the composition 50 is a personal care composition, it could be any personal care composition, such as an antiperspirant composition, a deodorant composition, a skin care composition, or a hair care composition. Herein, by "skin care composition" it is meant "a composition for which the intended use can include promotion or improvement of health, cleanliness, odor, appearance, or attractiveness of skin". Thus, the skin care composition could be a soap, such as a hand soap or a shaving soap, such as a liquid hand soap. Example hair care compositions include hair shampoo and hair conditioner. When the composition 50 is a home care composition, it could be any home care composition, such as a surface cleaner, a laundry detergent, a fabric cleaner, a fabric conditioner, a fabric softener, or a dish washing composition. The composition 50 may be a powder, but it is preferred that the composition 50 be a liquid. The composition 50 may include a colorant, so that the composition 50 is visible when dissolving in water. The colorant may give the composition 50 any color, such as white, cream, red, blue, green or yellow. The composition may be clear, opaque or translucent.

In a variation to the illustrated embodiment, the body 44 of the refill container 40 may not be a pouch, but may instead be any one of a cup, a bag, a sachet, and a packet. In some embodiments, the body 44 of the refill container 40 is collapsible according to a predetermined pattern of collapse. Thus, in some such embodiments, the body 44 of the refill container 40 may take the form of a bellows.

In the illustrated embodiment, a middle first portion of the body 44 of the refill container 40 is weaker than each of the first and second ends 41, 42 of the body 44 of the refill container 40, each of which first and second ends 41, 42 is termed a second portion of the body 44. For example, the first portion of the body 44 may be thinner than the second portion of the body 44, and/or the body 44 may comprise a plurality of layers of material, and the first portion of the body 44 has fewer of the layers of material than the second portion of the body 44. In some embodiments, the body comprises a visible indication as to a location of the first portion of the body 44, so that a user readily can identify the first portion of the body 44. The provision of these first and second portions of the body 44 means that the first portion of the body 44 gives the body 44 structural integrity, so that the body 44 may be capable of withstanding knocks and bumps without bursting, yet a user can aim the second portion of the body 44 at the distal end 21 of the protrusion 20 when it is desired to pierce the body 44 in the chamber 13 of the container 1. In variations to the illustrated embodiment, the location and form of each of the first and second portions of the body of the refill container may differ from those shown in the Figures. Accordingly, other configurations of first and second portion(s) of the body 44 of the refill container 40 will be apparent to the skilled person in light of the present disclosure.

The refill container 40 may be provided located within a package (not shown), such as one of a box, a bag and a pouch, to protect the refill container 40 prior to its intended use. A plurality of the refill containers 40 may be located within the same package. Each of the plurality of the refill containers 40 may contain the same composition 50, or some or all of the plurality of the refill containers 40 may contain a composition 50 that is different to a composition contained in some or all of the others of the plurality of the refill containers 40.

A method of using the refill container 40 of FIG. 2 with the container 1 of FIG. 1 will now be described with reference to FIGS. 1 to 6. Together the container 1 and the refill container 40 are comprised in an exemplary embodiment of a system according to the present invention. The system may comprise a plurality of the refill containers 40. Each of the plurality of the refill containers 40 may contain the same composition 50, or some or all of the plurality of the refill containers 40 may contain a composition 50 that is different to a composition contained in some or all of the others of the plurality of the refill containers 40.

Figure 4:
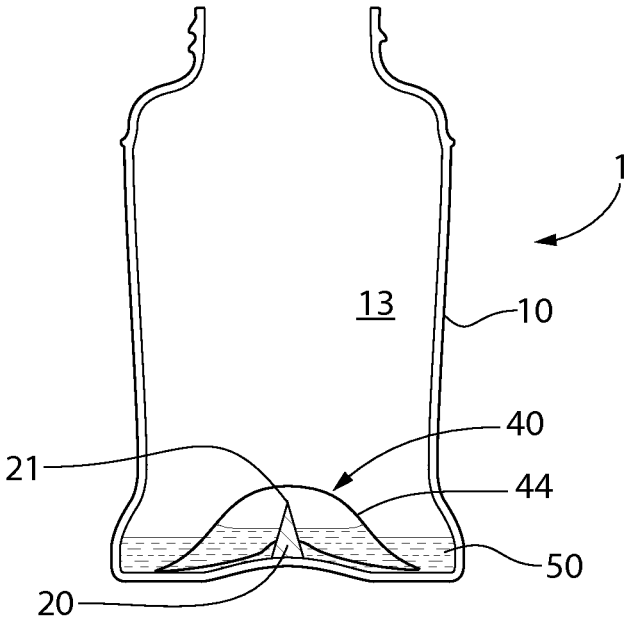
FIG. 4 is a cross section view of the refill container of FIG. 2 within the chamber of the body of FIG. 1 and with a body of the refill container having been pierced by a protrusion of the body of the container.

First, the container 1 and the refill container 40 are provided, as respectively shown in FIGS. 1 and 2. The container 1 is positioned with the contact portion 16 stably standing or supporting the container 1 on a horizontal support surface 5. Then, the refill container 40 is dropped into the chamber 13 defined by the body 10 of the container 1 from and through the opening 14 defined by the body 10 of the container 1. That is, a user holds the refill container 40 within the opening 14 and then drops the refill container 40 from the opening 14 into the chamber 13. Under the influence of gravity, the refill container 40 falls into the chamber 13 in the direction of the arrow marked D in FIG. 3, which is along the first axis A-A discussed above. Accordingly, the refill container 40 travels from the first end 11 of the chamber 13 towards the second end 12 of the chamber 13, and towards the distal end 21 of the projection 20 at the second end 12 of the chamber 13. As discussed above, the sharp distal end 21 of the protrusion 20 is for piercing the body 44 of the refill container 40 when the refill container 40 is dropped into the chamber 13 from and through the opening 12. Accordingly, as shown in FIG. 4, when the body 44 of the refill container 40 contacts the distal end 21 of the protrusion 20, the distal end 21 of the protrusion 20 pierces the body 44 of the refill container 40 and passes into or through the cavity 43 of the refill container 40. This piercing places the cavity 43 of the refill container 40 in fluid communication not only with an exterior of the body 44 of the refill container 40 but with the chamber 13 of the container 1. Accordingly, once the body 44 has been so pierced by the protrusion 20, the composition 50 flows from the cavity 43 of the refill container 40 into the chamber 13 of the container 1, again as shown in FIG. 4. Since the user is able to provide the composition 50 in the chamber 13 while the refill container 40 isolates the user from the composition 50, the user does not risk coming into contact with the composition 50.

Figure 5:
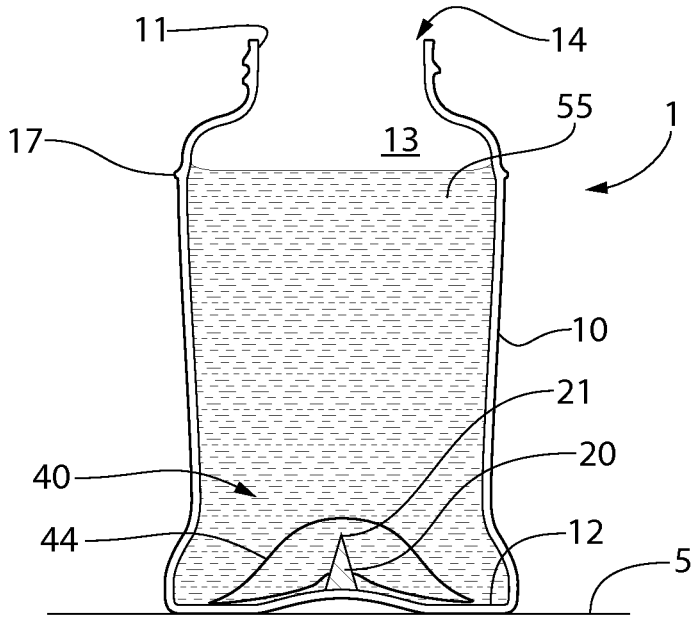
FIG. 5 is a cross section view of the components of FIG. 4 with a volume of water having been additionally provided in the chamber of the body of the container.

Next, the user adds a volume of water to the chamber 13 of the container 1, in order to dissolve or dilute the composition 50 to form a usable oral, personal or home care product. Prior to the body 44 of the refill container 40 being pierced, the composition 50 in the refill container 40 was in concentrated form and had a certain known first volume. As discussed above, the composition 50 stored in the cavity 43 of the refill container 40 is intended to be used when dissolved or diluted in a predetermined volume of water. This predetermined volume of water equals the maximum volume of liquid containable in the chamber 13 between the fill mark 17 and the second end 12 of the chamber 13 minus the known first volume of the composition 50 in the refill container 40 prior to piercing of the body 44 of the refill container 40 and minus the negligible volume of the material of the refill container 40 itself. Accordingly, with the system in the condition shown in FIG. 4, with the container 1 maintained in position with the contact portion 16 stably standing or supporting the container 1 on the horizontal support surface 5, the user pours water through the opening 14 and into the chamber 13 until a top surface 55 of the water/composition 50 solution reaches the fill mark 17, as shown in FIG. 5. The pouring of water into the chamber 13 not only dilutes the composition 50 to a predetermined intended concentration for use as an oral, personal or home care product, but it also helps to further evacuate the composition 50 from the cavity 43 of the refill container 40, and causes the body 44 of the refill container 40 to begin dissolving. Preferably, the body 44 of the refill container 40 is completely dissolvable in water at room temperature and atmospheric pressure within a predetermined time period that matches, or is less than, a time period, such as a time period of between 2 and 4 weeks, over which it is estimated that all of the water/composition 50 solution in the chamber 13 would be used-up by a user.

In a variation to the illustrated embodiment, it may be preferred to add a predetermined volume of water to the chamber 13 prior to dropping the refill container 40 into the chamber 13, in order to reduce the chance of the composition 50 being splattered or sprayed out of the chamber 13 through the opening 14. In such a variation, the container 1 preferably would be modified so that the fill mark 17 is closer to the second end 12 of the chamber 13, so that the maximum volume of liquid containable in the chamber 13 between the fill mark 17 and the second end 12 of the chamber 13 equals the predetermined volume of water intended to be used to dissolve or dilute the composition 50 to form a usable oral, personal or home care product.

Finally, the user moves a closure 60 of the container 1 relative to the body 10 of the container 1 from an open position (not shown), at which the closure 60 does not block the opening 14 defined by the body 10 of the container 1, to a closed position, at which the closure 60 blocks the opening 14, as shown in FIG. 6. The closure 60 is attachable to the body 10 at the first end 11 of the chamber 13 with no part of the closure 60 contacting or proximal the protrusion 20. In the illustrated embodiment, the closure 60 is detachably connectable to the body 10 through cooperation of respective screw threads 19 of the closure 60 and the body 10, as is known in the art. In variations to the illustrated embodiment, the closure 60 may be detachably connectable to the body 10 using mechanisms other than cooperating screw threads, such as a bayonet coupling, friction fit, or magnetically attractive materials. In such other variations to the illustrated embodiment, the screw threads 19 of the closure 60 and the body 10 may be omitted.

The closure 60 comprises a pump 62 (not all of which is shown in the Figures) for pumping the water/composition 50 solution from the chamber 13 of the container 1 to an outlet 63 of the closure 60 and the container 1 when the closure 60 is at the closed position. Accordingly, the device shown in FIG. 6 can be considered a pump dispenser 200 comprising the container 1 and according to an embodiment of the present invention, and together the pump dispenser 200 and the refill container 40 are comprised in another exemplary embodiment of a system according to the present invention. The closure 60 also comprises a dip tube 64 with a lumen 65 fluidly connected to the pump 62. The dip tube 64 extends from the pump 62 towards the second end 12 of the chamber 13 when the closure 60 is at the closed position, as shown in FIG. 6. That is, a first end (not shown) of the dip tube 64 attached to the pump 62 is a proximal end of the dip tube 64, and a second end of the dip tube remote from the pump 62 is a distal end 66 of the dip tube 64. Preferably, and as shown in the illustrated embodiment, the dip tube 64 has a length between its proximal and distal ends sufficient that the distal end 66 of the dip tube 64 contacts the second end 12 of the chamber 13. Most preferably, and again as shown in the illustrated embodiment, the distal end 66 of the dip tube 64 contacts the second end 12 of the chamber 13 at a position spaced from the protrusion 20, so that the protrusion 20 does not hinder fluid flow through the lumen 65 of the dip tube 64, and so that the distal end 66 of the dip tube 64 is as close to the second plane $P_2$-$P_2$ as possible, to enable as complete an evacuation of the water/composition 50 solution from the chamber 13 by pumping as possible.

An exemplary embodiment of another pump dispenser 300 according to the present invention will now be described with reference to FIGS. 7, 9 and 10. The pump dispenser 300 is usable with the refill container 40 discussed above.

Broadly speaking, the pump dispenser 300 comprises a container 2, a closure 160, a pump 170, and a projection 180 extending from the closure 160.

Figure 7:
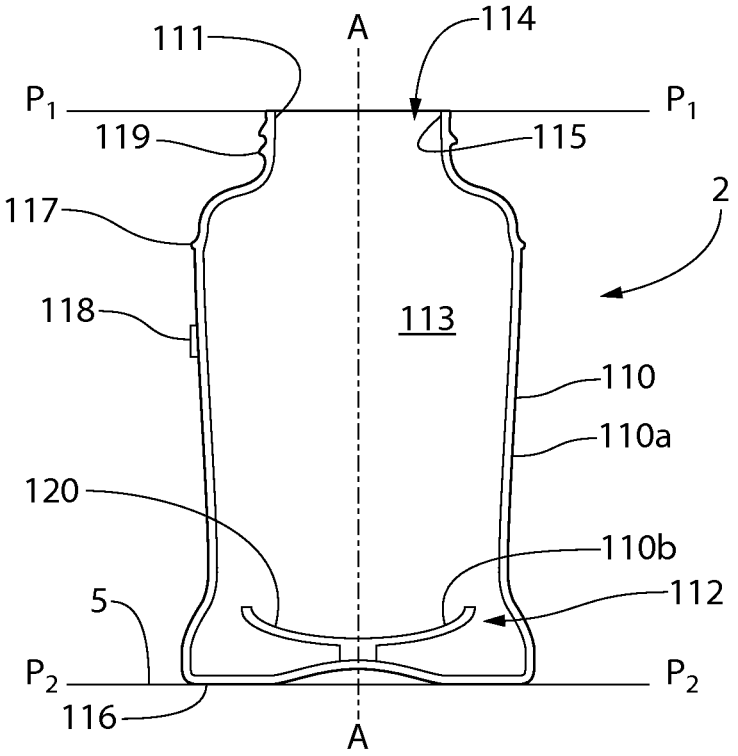
FIG. 7 is a cross section view of a container for a pump dispenser.

The container 2 of the pump dispenser 300 is shown in isolation in FIG. 7. The container 2 comprises a body 110 that defines a chamber 113 for storing a product. The chamber 113 has a first end 111 and a second end 112. The body 110, or more specifically a rim 115 of the body 110, defines an opening 114 at the first end 111 of the chamber 113, through which opening 114 the product is dispensable from the chamber 113. The rim 115 lies in a first plane $P_1$-$P_1$. The opening 114 extends along a first axis A-A that is central to the opening 114 and normal to the first plane $P_1$-$P_1$. In the illustrated embodiment, the opening 114 is circular and the first axis A-A passes through a center of the opening 114. In variations to the illustrated embodiment, the opening 114 may be of any other shape, such as elliptical, polygonal, square, rectangular or triangular. However, preferably, but not necessarily, in such variations the opening 114 still extends along a first axis A-A that is central to the opening 114.

The body 110 comprises a contact portion 116 at an exterior of the body 110 and the pump dispenser 300 and lying in a second plane $P_2$-$P_2$, which second plane $P_2$-$P_2$ is parallel to the first plane $P_1$-$P_1$. The contact portion 116 is for stably standing the body 110 and the pump dispenser 300 as a whole on a horizontal support surface 5. In the illustrated embodiment, the contact portion 116 is annular. The contact portion 116 may be planar or follow an annular line. In variations to the illustrated embodiment, the contact portion may be of a different shape, such as elliptical, polygonal, square, rectangular or triangular. In some variations to the illustrated embodiment, the body 110 comprises a plurality of contact portions lying in the second plane $P_2$-$P_2$. In some variations to the illustrated embodiment, the body 110 comprises one or more non-planar contact portions lying in the second plane $P_2$-$P_2$, such as one or more point apexes or line apexes that are each a portion of a curved or non-planar surface of the body 110, yet the combination of the contact portion(s) of the body 110 enables the body 110 and the pump dispenser 300 as a whole to stand stably on the horizontal support surface 5. Other configurations of contact portion(s) of the body 110 will be apparent to the skilled person in light of the present disclosure.

The body 110 may be made from any suitable material, such as a hard plastic. Example plastics are thermoplastic polymers, such as polypropylene (PP) or polyethylene terephthalate (PET). The body 110 is transparent, to enable a user to view contents of the chamber 113 from the exterior of the body 110 and pump dispenser 300. In a variation to the illustrated embodiment, the body 110 may be translucent. In further variations to the illustrated embodiment, some or all of the body 110 may be opaque but, in some such further variations, only a first portion of the body 110 is opaque while a second portion of the body 110 is transparent or translucent, again to enable a user to view contents of the chamber 113 from the exterior of the body 110 and pump dispenser 300. The body 110 has a fill mark 117 provided thereon at a position between the first and second ends 111, 112 of the chamber 113. The fill mark 117 is visible to a user from the exterior of the body 110 and pump dispenser 300. The fill mark comprises a fill line that may extend partially or fully around a perimeter of the body 110, so that the fill mark is visible to a user regardless as to the side of the body 110 the user is viewing. In the illustrated embodiment, the fill mark comprises a ridge 117 that protrudes from an exterior surface of the body 110. In variations to the illustrated embodiment, the fill mark may comprise a groove or channel formed in the exterior surface of the body 110, or may comprise printing adhered or otherwise provided on the exterior surface of the body 110. In other variations to the illustrated embodiment, the fill mark may be a ridge, groove or other formation on an interior surface of the body 110, which interior surface of the body 110 delimits the chamber 113. Other configurations of the fill mark will be apparent to the skilled person in light of the present disclosure. The pump dispenser 300 further comprises a visible indication 118 of a maximum volume of liquid containable in the chamber 113 between the fill mark 117 and the second end 112 of the chamber 113. In the illustrated embodiment, the visible indication 118 comprises text provided on the exterior surface of the body 10, but in variations to the illustrated embodiment the visible indication 118 may comprise text or another indication provided on the interior surface of the body 110 or elsewhere on the pump dispenser 300.

The body 110 further comprises a first surface 120 at the second end 112 of the chamber 113, the second end 112 being opposite from the first end 111 of the chamber 113. The first surface 120 is for cooperating with a second surface 184 of the projection 180 to compress or squeeze the refill container 40 therebetween, as will be described below. In the illustrated embodiment, the body 110 comprises a vessel 110*a* defining the chamber 113 and opening 114 and comprising the rim 115 and the contact portion 116. Moreover, the fill mark 117 is provided on the vessel 110*a*. The body 110 also comprises an internal member 110*b* within the chamber 113 and at the second end 112 of the chamber 113, and the first surface 120 of the body 110 is a surface 120 of the internal member 110*b*. In the illustrated embodiment, the internal member 110*b* is non-unitary with the vessel 110*a* and is affixed to the vessel 110*a*, specifically to the interior surface of the vessel 110*a* that defines the chamber 113. The internal member 110*b* may be made from metal, such as aluminium, or a hard plastic. Example plastics are thermoplastic polymers, such as polypropylene (PP) or polyethylene terephthalate (PET). In variations to the illustrated embodiment, the internal member 110*b* may be unitary with the vessel 110*a*. In such variations, it is preferred that the vessel 110*a* and the internal member 110*b* be molded from a plastic, such as those discussed above for the internal member 110*b*.

Figure 8:
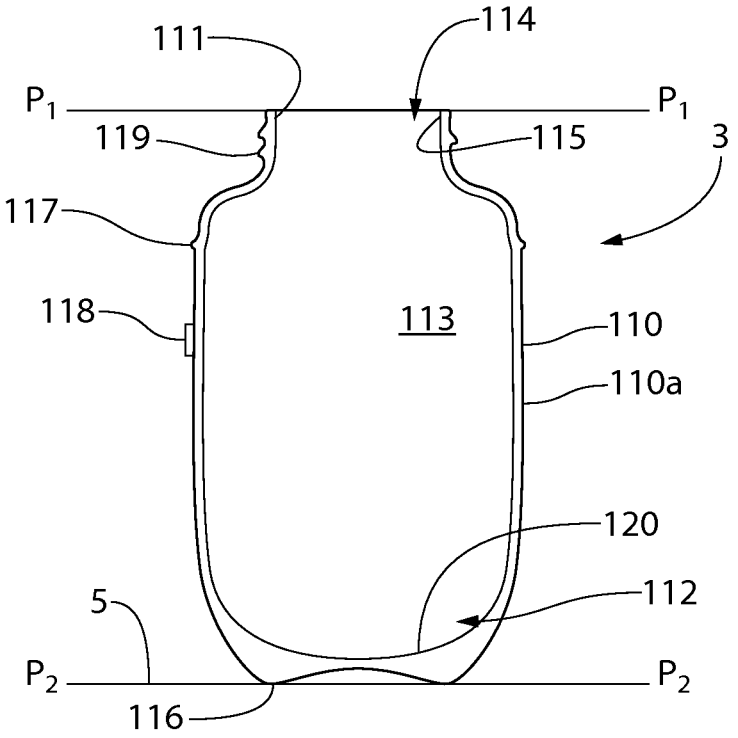
FIG. 8 is a cross section view of an alternative container for a pump dispenser.

In a variation to the embodiment illustrated in FIG. 7, and as illustrated in FIG. 8, the body 110 of the container 3 does not comprise an internal member, and the first surface 120 instead is a surface of the vessel 110*a* of the body 110, i.e. a surface of the body 110 that at least partially defines the chamber 113. In both the embodiments of FIGS. 7 and 8, the first surface 120 is considered a surface of the body 110 of the container 2, 3.

Figure 9:
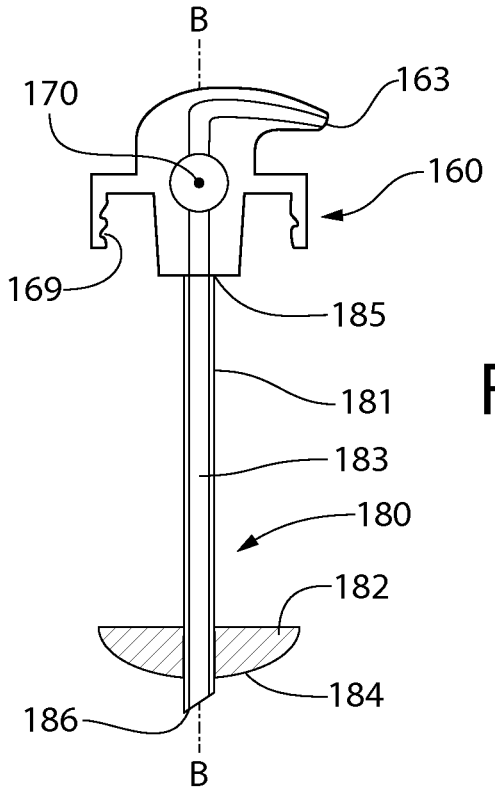
FIG. 9 is a cross section view of a combination of a closure, a pump and a projection for a pump dispenser.
Figure 10:
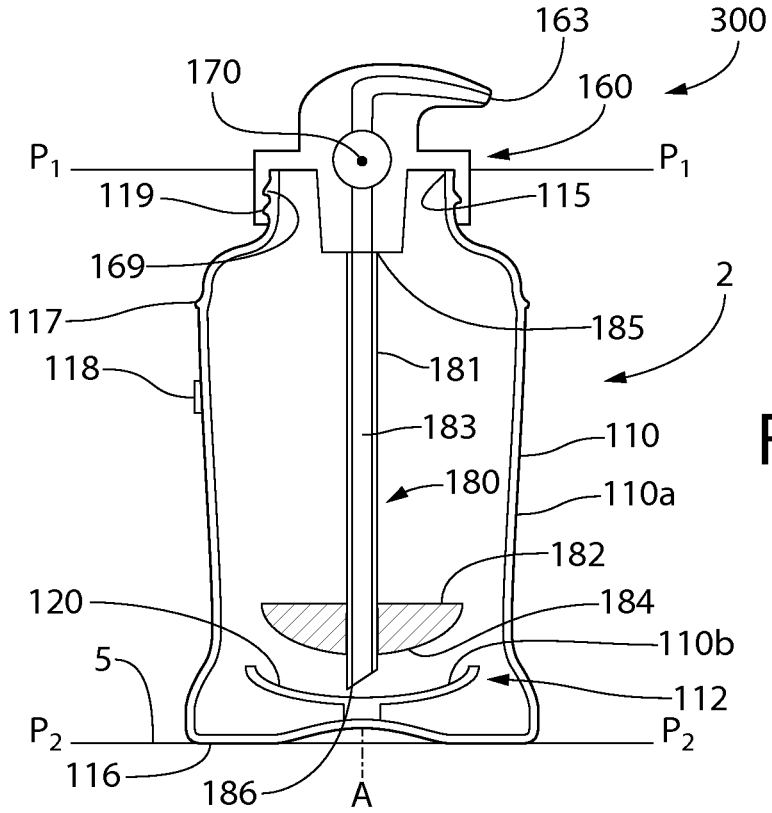
FIG. 10 is a cross section view of a pump dispenser according to an embodiment of the present invention, the pump dispenser comprising the container of FIG. 7 and the combination of components of FIG. 9.

The closure 160, pump 170 and projection 180 of the pump dispenser 300 are shown together in isolation in FIG. 9, and in combination with the body 110 in FIG. 10. The closure 160 is movable relative to the body 110 between a closed position (see FIG. 10) at which the closure 160 blocks the opening 114 defined by the body 110 and an open position (see FIG. 7) at which the opening 114 is not blocked by the closure 160. In the illustrated embodiment, the closure 160 is detachably connectable to the body 110 through cooperation of respective screw threads 119, 169 of the closure 160 and the body 110, as is known in the art. In variations to the illustrated embodiment, the closure 160 may be detachably connectable to the body 110 using mechanisms other than cooperating screw threads, such as a bayonet coupling, friction fit, or magnetically attractive materials. In such other variations to the illustrated embodiment, the screw threads 119, 169 of the closure 160 and the body 110 may be omitted.

The pump 170 is fixed to the closure 160 and is shown only schematically in the Figures. The pump 170 is for pumping the product from the chamber 113 through the opening 114 and to an outlet 163 of the closure 160 and the pump dispenser 300 when the closure 160 is at the closed position relative to the body 110.

The projection 180 extends from the closure 160. When the closure 160 is at the closed position relative to the body 110, the projection 180 is located in the chamber 113. The projection 180 comprises a first portion 181 extending from the closure 160 in a first direction and a second portion 182 extending from the first portion 181 in a second direction that is different to the first direction. In the illustrated embodiment, the first portion 181 extends from the closure 160 along a second axis B-B, and the second portion 182 extends from the first portion radially outwards with respect to the second axis B-B, so that the second direction is orthogonal to the first direction. When the closure 160 is at the closed position relative to the body 110, the second axis B-B is coextensive with the first axis A-A discussed above so that the first portion 181 extends from the closure 160 in a direction normal to the first plane $P_1$-$P_1$.

The second portion 182 has the second surface 184, mentioned above, of the projection 180, which second surface 184 is for cooperating with the first surface 120 of the body 110 to compress or squeeze the refill container 40 therebetween. The second surface 184 is oriented relative to the closure 160 such that the second surface 184 faces and approaches the first surface 120 of the body 110 when the closure 160 is moved relative to the body 110 from the open position to the closed position.

The first portion 181 of the projection is a rigid dip tube with a lumen 183 fluidly connected to the pump 170. The dip tube 181 extends from the pump 170 towards the second end 112 of the chamber 113 when the closure 160 is at the closed position, as shown in FIG. 10. That is, a first end of the dip tube 181 attached to the pump 170 is a proximal end 185 of the dip tube 181, and a second end of the dip tube 181 remote from the pump 170 is a distal end 186 of the dip tube 181 and a distal end of the projection 180. It will be noted from FIG. 9 that the dip tube 181 extends through the second portion 182 of the projection 180, so that the distal end 186 of the dip tube 181 projects from the second surface 184 of the second portion 182 of the projection 180, so that the distal end 186 of the dip tube 181 is further from the closure 160 than the second surface 184 of the second portion 182. Moreover, it will be noted from FIG. 9 that the distal end 186 of the dip tube 181 is tapered, to facilitate piercing of the body 44 of the refill container 40, as will be described below. However, in variations to the illustrated embodiment, the distal end 186 of the dip tube 181 may not be tapered and instead may be substantially orthogonal to the second axis B-B. In some variations to the illustrated embodiment, the distal end 186 of the dip tube 181 may be flush with, or recessed relative to, the second surface 184 of the second portion 182 of the projection 180, so that the distal end 186 of the dip tube 181 is not further from the closure 160 than the second surface 184 of the second portion 182. Preferably, and as is the case in the illustrated embodiment, the dip tube 181 has a length between its proximal and distal ends 185, 186 so that the distal end 186 of the dip tube 181 is spaced from the first surface 120 of the body 110 when the closure 160 is at the closed position relative to the body 110, as shown in FIG. 10, so that the first surface 120 of the body 110 does not hinder fluid flow through the lumen 183 of the dip tube 181. In variations to the illustrated embodiment, the first surface 120 of the body 110 has a recess therein dimensioned so as to avoid collision between the distal end 186 of the dip tube 181 and the first surface 120. The recess may not be fully enclosed, so that fluid is able to be drawn into the lumen 183 from above the first surface 120 or below it for better evacuation of the chamber 113 of the container 2.

In the illustrated embodiment, and as shown in FIG. 10, the second surface 184 of the second portion 182 of the projection 180 is spaced from the first surface 120 of the body 110 when the closure 160 is at the closed position relative to the body 110, so as to enable the refill container 40 to be accommodated between the first and second surfaces 120, 184. However, it is preferable that the first and second surfaces 120, 184 be close to each other when the closure 160 is at the closed position relative to the body 110, so that the first and second surfaces 120, 184 are cooperable to compress or squeeze the refill container 40 when it is located between the first and second surfaces 120, 184. Accordingly, preferably the second surface 184 of the second portion 182 is spaced from the first surface 120 of the body by less than 5 millimeters when the closure 160 is at the closed position relative to the body 110. More preferably, the second surface 184 of the second portion 182 is spaced from the first surface 120 of the body by less than 1 millimeter when the closure 160 is at the closed position relative to the body 110. In a variation to the illustrated embodiment, the second surface 184 of the second portion 182 contacts the first surface 120 of the body 110 when the closure 160 is at the closed position relative to the body 110.

It will be seen from FIGS. 7, 9 and 10 that the first and second surfaces 120, 184 have matching surface profiles. More particularly, the first surface 120 is concave and the second surface 184 is convex. The concave nature of the first surface 120 means the first surface 120 is suitable for receiving the refill container 40 and retaining the refill container 40 in position relative to the body 110 for subsequently squeezing the refill container 40. The point of the first surface 120 furthest from the opening 114 lies on the axis A-A, which encourages the refill container 40 to lie on the axis A-A when dropped into the chamber 113. This maximizes alignment of the refill container 40 with the second surface 184 for subsequently squeezing the refill container 40, especially in embodiments in which the cross sectional size of the chamber 113 orthogonal to the axis A-A and remote from the opening 114 is appreciably larger than the cross sectional size of the chamber 113 orthogonal to the axis A-A at the opening 114. In a variation to the illustrated embodiment, the first surface 120 is convex and the second surface 184 is concave. In some embodiments, one of the first and second surfaces 120, 184 comprises a recess and the other of the first and second surfaces 120, 184 comprises a protuberance. The embodiment illustrated in FIGS. 7, 9 and 10 is an example of such a construction, but in variations to the illustrated embodiment the recess and/or the protuberance may be other than concave and/or convex, respectively, such as polygonal. In some embodiments one or each of the first and second surfaces 120, 184 is flat or substantially flat.

In a variation to the illustrated embodiment, the container 2 may comprise a protrusion extending from the body 110 into the chamber 113, the protrusion having a sharp distal end in the chamber 113. The protrusion may extend from the body 110 into the chamber 113 at the second end 112 of the chamber 113. The protrusion may take the form of the protrusion 20 discussed above, or any one of the variations on the protrusion 20 discussed above. The protrusion may extend from the first surface 120. The protrusion may be axially aligned with the lumen 183 of the dip tube 181, and further the protrusion may be dimensioned relative to the lumen 183 so that the sharp distal end of the protrusion becomes located, or nests, in the lumen 183 when the closure 160 is moved from the open position to the closed position relative to the body 110. Accordingly, in some embodiments, a body 44 of a refill container 40 lying on the first surface 120 would be pierced both by the sharp distal end of the protrusion and by the tapered distal end 186 of the dip tube 181. In some embodiments, the container 2 comprises a plurality of protrusions extending from the body 110 into the chamber 113, each of the plurality of protrusions having a sharp distal end in the chamber 113. Some or all of the plurality of protrusions may extend from the body 110 into the chamber 113 at the second end 112 of the chamber 113. Some or all of the protrusions may extend from the first surface 120. For conciseness, no further discussion will be made of the provision of such a protrusion or protrusions in the chamber 113 of the body 110 of the container 2.

A method of using the refill container 40 of FIG. 2 with the pump dispenser of FIGS. 7, 9 and 10 will now be described. Together the pump dispenser 300 and the refill container 40 are comprised in another exemplary embodiment of a system according to the present invention. The system may comprise a plurality of the refill containers 40. Each of the plurality of the refill containers 40 may contain the same composition 50, or some or all of the plurality of the refill containers 40 may contain a composition 50 that is different to a composition contained in some or all of the others of the plurality of the refill containers 40.

First, the pump dispenser 300 and the refill container 40 are provided, as respectively shown in FIGS. 10 and 2. The pump dispenser 300 is positioned with the contact portion 116 stably standing or supporting the pump dispenser 300 on a horizontal support surface 5, as shown in FIG. 10. Then, the user moves the closure 160 of the pump dispenser 300 relative to the body 110 from the closed position shown in FIG. 10 to the open position at which the opening 114 is not blocked by the closure 160, as shown in FIG. 7.

The refill container 40 is then dropped into the chamber 113 defined by the body 110 from and through the opening 114 defined by the body 110. That is, a user holds the refill container 40 within the opening 114 and then drops the refill container 40 from the opening 114 into the chamber 113. Under the influence of gravity, the refill container 40 falls into the chamber 113 along the first axis A-A. Accordingly, the refill container 40 travels from the first end 111 of the chamber 113 towards the second end 112 of the chamber 113 until it lands on the first surface 120 of the body 110 at the second end 112 of the chamber 113. Again, since the user is able to provide the composition 50 in the chamber 113 while the refill container 40 isolates the user from the composition 50, the user does not risk coming into contact with the composition 50.

The user then moves the closure 160 of the pump dispenser 300 relative to the body 110 from the open position towards the closed position. During this movement, the second surface 184 of the second portion 182 of the projection 180 faces and approaches the first surface 120 of the body 110 until the second surface 184 contacts the body 44 of the refill container 40 lying on the first surface 120 of the body 110. Continued movement of the closure 160 relative to the body 110 towards the closed position causes the body 44 of the refill container 40 to be compressed or squeezed between the first and second surfaces 120, 184 until the body 44 of the refill container 40 bursts or ruptures. This bursting or rupturing places the cavity 43 of the refill container 40 in fluid communication not only with an exterior of the body 44 of the refill container 40 but with the chamber 113. Accordingly, once the body 44 has been so burst or ruptured, the composition 50 flows from the cavity 43 of the refill container 40 into the chamber 113.

Next, the user adds a volume of water to the chamber 113, in order to dissolve or dilute the composition 50 to form a usable oral, personal or home care product. As discussed above, the composition 50 stored in the cavity 43 of the refill container 40 is intended to be used when dissolved or diluted in a predetermined volume of water. This predetermined volume of water equals the maximum volume of liquid containable in the chamber 113 between the fill mark 117 and the second end 112 of the chamber 113 minus the known first volume of the composition 50 in the refill container 40 prior to rupturing of the body 44 of the refill container 40 and minus the negligible volume of the material of the refill container 40 itself. Accordingly, the user pours water through the opening 114 and into the chamber 113 until a top surface of the water/composition 50 solution reaches the fill mark 117. As also discussed above, the pouring of water into the chamber 113 not only dilutes the composition 50 to a predetermined intended concentration for use as an oral, personal or home care product, but it also helps to further evacuate the composition 50 from the cavity 43 of the refill container 40, and causes the body 44 of the refill container 40 to begin dissolving. Finally, the user actuates the pump 170 to pump the water/composition 50 solution from the chamber 113 to the outlet 163.

In a variation to the illustrated embodiment, it may be preferred to add a predetermined volume of water to the chamber 113 prior to dropping the refill container 40 into the chamber 113, in order to reduce the chance of the composition 50 being splattered or sprayed out of the chamber 113 through the opening 114. In such a variation, the container 2 preferably would be modified so that the fill mark 117 is closer to the second end 112 of the chamber 113, so that the maximum volume of liquid containable in the chamber 113 between the fill mark 117 and the second end 112 of the chamber 113 equals the predetermined volume of water intended to be used to dissolve or dilute the composition 50 to form a usable oral, personal or home care product.

In a variation to the illustrated embodiment of the pump dispenser 300, the projection 180 may comprise one or more connectors, such as hook(s) and/or clip(s), for connecting a refill container to the projection 180. The connectors may be located on the second portion 182 of the projection 180, and may be located on the second surface 184 of the second portion 182. Correspondingly, in a variation to the illustrated embodiment of the refill container 40 shown in FIG. 2, the refill container may comprise one or more connectors, such as hook(s) and/or clip(s), for connecting the refill container 40 to the one or more connectors of the projection 180 of the pump dispenser 300. The connector(s) of the refill container 40 may be located at one or each of the first and second ends 41, 42 of the body 44 of the refill container 40. Through the provision of such connector(s) of the pump dispenser 300 and the refill container 40, the refill container 40 may be connected to the projection 180 prior to insertion of the projection 180 into the chamber 113, and instead of dropping the refill container 40 onto the first surface 120 of the body 110 as discussed above, so that the location of the refill container 40 relative to the first and second surfaces 120, 184 may be better controlled. In other words, the position of the refill container 40 relative to the projection 180 may be substantially fixed so that, when the closure 160 is moved to its closed position relative to the body 110, it can be better ensured that the refill container 40 will be located between the first and second surfaces 120, 184 for compression therebetween. In some such variations to the illustrated embodiment of the refill container 40 shown in FIG. 2, the body 44 of the refill container 40 is not water soluble. However, after the water/composition 50 solution formed in the chamber 113 has been used up, or used to the extent desired by a user, the user may move the closure 160 to its open position relative to the body 110 and, in doing so, withdraw the remains of the refill container 40 from the chamber 113 without having to touch the refill container 40.

In respective variations to the system comprising the pump dispenser 300 and the refill container 40 discussed above, the system comprises, and the pump dispenser 300 is usable with, a refill container different to that shown in FIG. 2. For example, the body 44 of the refill container 40 may not be a pouch, but may instead be any one of a cup, a bag, a sachet, and a packet. In some embodiments, the body 44 of the refill container 40 is collapsible according to a predetermined pattern of collapse. Thus, in some such embodiments, the body 44 of the refill container 40 may take the form of a bellows. In any embodiment, optionally all or part of the refill container 40 is water soluble, to leave little or nothing of the refill container 40 that needs to be discarded from the chamber of the container before the next refill cycle is performed.

In variations to the pump dispenser 300 shown in FIGS. 7, 9 and 10, the dip tube 181 is replaced by a rigid solid rod or stick connected to and extending from the closure 160 towards the second end 112 of the chamber 113 when the closure 160 is at the closed position. In some such variations, the water/composition 50 solution in the chamber 113 is pumped to the outlet 163 via a different route, such as via a tube formed in the body 110 or via a flexible dip tube that extends from the closure 160 into the chamber 113 in parallel to the rigid solid rod or stick. In some such variations, the pump 170 may be fixed to the body 110 rather than to the closure 160, and in some variations the outlet is formed in the body 110 rather than in the closure 160. In some such variations, there need not be a pump for pumping the solution out of the outlet. A user may pour the solution out of the chamber 113 via the opening 114, rather than pump the solution out of the chamber 113. In such variations, the apparatus is then a container, rather than a pump dispenser.

What is claimed is:

1. A pump dispenser, comprising:

a container comprising a body defining a chamber for storing a product and defining an opening at a first end of the chamber through which the product is dispensable from the chamber, the body having a first surface at a second end of the chamber, opposite from the first end of the chamber;

a closure movable relative to the body between a closed position at which the closure blocks the opening and an open position at which the opening is not blocked by the closure;

a pump for pumping the product from the chamber; and a projection extending from the closure, the projection comprising a first portion extending from the closure in a first direction and a second portion extending from the first portion in a second direction, the second direction being different to the first direction, the second portion having a second surface that faces and approaches the first surface of the body when the closure is moved relative to the body from the open position to the closed position.

2. The pump dispenser of claim 1, wherein the first portion extends from the closure along an axis and the second portion extends from the first portion radially outwards with respect to the axis.

3. The pump dispenser of claim 1, wherein a rim of the body defines the opening, wherein the rim lies in a first plane, and wherein the first portion extends from the closure in a direction normal to the first plane.

4. The pump dispenser of claim 1, wherein the first portion of the projection comprises a dip tube with a lumen fluidly connected to the pump, and wherein a distal end of the dip tube is further from the closure than the second surface of the second portion.

5. The pump dispenser of claim 1, wherein the first portion of the projection is rigid and wherein a distal end of the projection is tapered.

6. The pump dispenser of claim 1, wherein a distal end of the projection is spaced from the first surface of the body when the closure is at the closed position relative to the body.

7. The pump dispenser of claim 1, wherein the second surface of the second portion is spaced from the first surface of the body by less than 5 millimeters when the closure is at the closed position relative to the body.

8. The pump dispenser of claim 7, wherein the second surface of the second portion is spaced from the first surface of the body by less than 1 millimeter when the closure is at the closed position relative to the body.

9. The pump dispenser of claim 1, wherein the first and second surfaces have matching surface profiles.

10. The pump dispenser of claim 1, wherein one of the first and second surfaces comprises a recess and the other of the first and second surfaces comprises a protuberance.

11. The pump dispenser of claim 1, wherein one of the first and second surfaces is concave and the other of the first and second surfaces is convex.

12. The pump dispenser of claim 1, wherein the projection comprises a connector for connecting a refill container to the projection.

13. The pump dispenser of claim 1, wherein the container comprises a protrusion extending from the body into the chamber, the protrusion having a sharp distal end in the chamber.

14. The pump dispenser of claim 13, wherein the protrusion extends from the body into the chamber at the second end of the chamber.

15. A system, comprising:

a pump dispenser according to claim 1; and a refill container comprising a body defining a cavity storing a composition;

wherein the refill container is insertable into the chamber through the opening.

16. The system of claim 15, wherein the projection comprises a connector for connecting the refill container to the projection, and wherein the refill container comprises a connector for connecting the refill container to the connector of the projection.

17. The system of claim 15, wherein the composition is an oral, personal or home care composition, and wherein the composition comprises water in an amount of less than 98% by weight, based on a total weight of the composition.

18. The system of claim 15, wherein the composition comprises water in an amount of less than 98% by weight, based on a total weight of the composition.

19. The system according to claim 15, wherein the body of the refill container is water-soluble.

20. The system according to claim 19, wherein the body of the refill container is completely dissolvable in water at room temperature and atmospheric pressure within a time period of between 2 and 4 weeks.

* * * * *